US011898551B2

(12) United States Patent
He et al.

(10) Patent No.: US 11,898,551 B2
(45) Date of Patent: Feb. 13, 2024

(54) SYSTEM FOR MANAGING PUMP LOAD

(71) Applicant: Caterpillar Inc., Peoria, IL (US)

(72) Inventors: Yuesheng He, Sugar Land, TX (US); Todd Ryan Kabrich, Tomball, TX (US); Casey Alan Otten, Spring, TX (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/724,351

(22) Filed: Apr. 19, 2022

(65) Prior Publication Data

US 2023/0332592 A1 Oct. 19, 2023

(51) Int. Cl.

*F04B 47/00* (2006.01)
*F04B 49/22* (2006.01)
*F04B 49/10* (2006.01)

(52) U.S. Cl.

CPC ..... *F04B 49/22* (2013.01); *F04B 47/00* (2013.01); *F04B 49/103* (2013.01); *F04B 2203/0605* (2013.01); *F04B 2207/01* (2013.01)

(58) Field of Classification Search

CPC ..... F04B 49/22; F04B 47/00; F04B 49/10; F04B 2203/0605; F04B 2207/01

See application file for complete search history.

(56) References Cited

U.S. PATENT DOCUMENTS

| | | | | |
|---|---|---|---|---|
| 10,190,718 | B2 | 1/2019 | Weinstein et al. | |
| 10,358,035 | B2 | 7/2019 | Cryer et al. | |
| 10,794,166 | B2 | 10/2020 | Reckels et al. | |
| 10,865,624 | B1 | 12/2020 | Cui et al. | |
| 11,187,069 | B2 | 11/2021 | Coli et al. | |
| 2018/0223831 | A1* | 8/2018 | Zhang | F04B 51/00 |
| 2019/0071951 | A1* | 3/2019 | Spencer | E21B 41/00 |
| 2021/0131410 | A1 | 5/2021 | Curry et al. | |

FOREIGN PATENT DOCUMENTS

WO WO2015011223 A2 1/2015

* cited by examiner

*Primary Examiner* — Connor J Tremarche
(74) *Attorney, Agent, or Firm* — Lee & Hayes, P.C.

(57) ABSTRACT

An example system includes a fluid end having a block, a fluid inlet formed in the block, and a fluid outlet formed in the block. The system also includes an intake manifold fluidly coupled to the fluid inlet, and a fluid conduit fluidly coupled to the fluid outlet and the intake manifold. The system further includes a valve fluidly coupled to the fluid conduit, the valve configured to control fluid flow through the fluid conduit, an actuator coupled to the valve and configured to position the valve in an open position or a closed position, and a controller communicatively coupled to the actuator and configured to send one or more signals to the actuator, causing the actuator to position the valve in the open position or the closed position.

20 Claims, 5 Drawing Sheets

SYSTEM FOR MANAGING PUMP LOAD

TECHNICAL FIELD

The present disclosure relates to a pump system. More specifically, the present disclosure relates to a system that circulates fluid between a fluid end and an intake manifold to unload a well stimulation pump during start up or wind down of a prime mover that drives the well stimulation pump.

BACKGROUND

Hydraulic fracturing is a well stimulation technique that typically involves pumping hydraulic fracturing fluid into a wellbore at a specific rate and pressure necessary to form factures in a rock formation surrounding a targeted region of the wellbore. This well stimulation technique often enhances the natural fracturing of a rock formation in order to increase the permeability of the rock formation, thereby improving recovery of oil, natural gas, and/or other fluids. For example, such techniques are also performed to enhance recovery of water in water wells.

In order to fracture such rock formations, the hydraulic fracturing fluid is injected into the wellbore at high pressures. Typically, a series of pumps are used to achieve such high-pressure injection of the hydraulic fracturing fluid. The series of pumps may be powered by prime movers (e.g., diesel engines, electric motors, natural gas engines, etc.). During a hydraulic fracturing process, several pumps are pumping at the same time with several prime movers powering the pumps. If one of the pumps being used encounters a problem and needs to be shut down, a backup pump can be started to maintain a flow rate of hydraulic fracturing fluid being pumped into the wellbore. Due to the high pressure of the hydraulic fracturing fluid being pumped into the wellbore, prime movers often lack the necessary torque to start a backup pump when the prime mover is operating at a slow speed. Furthermore, with electric motors, starting the backup pump against such a high pressure load leads to a high electrical need which can generate high levels of heat, which can cause additional problems to arise.

An example hydraulic fracturing system is described in U.S. Pat. No. 10,190,718 (hereinafter referred to as "the '718 reference"). In particular, the '718 reference describes an accumulator assembly for a hydraulic fracturing system that is fluidly connectable to a flow line between a blender and a fracturing pump of the hydraulic fracturing system. The '718 reference describes that the accumulator assembly includes a pressurizable tank that contains a pressurized fluid and a control valve fluidly connected to a discharge end of the pressurizable tank and the flow line. The '718 reference describes that the control valve is opened to fluidly connect the pressurizable tank to the flow line when a pressure on the flow line is less than a target pressure. The control valve, described in the '718 reference, is closed when the pressure on the flow line is greater than or substantially the same as the target pressure.

However, the hydraulic fracturing system described in the '718 reference maintains a load on the hydraulic fracturing pumps unless a hydraulic fracturing process is stopped. As such, in order to start prime movers during the hydraulic fracturing process, the system described in the '718 reference requires large amounts of fuel to start a prime mover against such a high load, and electrical motors would require high power requirements. Furthermore, starting or winding down the prime movers under such a high load could damage or reduce a useful life of a prime mover and/or pumps used in the hydraulic fracturing process.

Example embodiments of the present disclosure are directed toward overcoming the deficiencies described above.

SUMMARY

An example system includes a fluid end having a block, a fluid inlet formed in the block, and a fluid outlet formed in the block. The system also includes an intake manifold fluidly coupled to the fluid inlet, and a fluid conduit fluidly coupled to the fluid outlet and the intake manifold. The system further includes a valve fluidly coupled to the fluid conduit, the valve configured to control fluid flow through the fluid conduit, an actuator coupled to the valve and configured to position the valve in an open position or a closed position, and a controller communicatively coupled to the actuator and configured to send one or more signals to the actuator, causing the actuator to position the valve in the open position or the closed position.

An example method includes receiving an indication that a prime mover of a fluid system is starting up, the prime mover configured to drive operation of a pump via a transmission, the pump including a plunger disposed at least partially within a fluid end, and receiving sensor data from one or more sensors, the sensor data associated with at least one of the prime mover, the transmission coupled to the prime mover, or the pump coupled to the transmission. The method further includes determining, based at least in part on the sensor data, that a driver speed of the prime mover is less than a threshold driver speed, determining, based at least in part on the sensor data, that the transmission is engaged, and causing an actuator to position a valve in an open position based at least in part on determining that the driver speed is less than the threshold driver speed and determining that the transmission is engaged, wherein fluid circulates between a fluid outlet of the fluid end and an intake manifold fluidly coupled to the fluid end when the pump is operating while the valve is positioned in the open position.

In a further example, a fluid system includes a fluid end having a block, a fluid inlet formed in the block, and a fluid outlet formed in the block. The fluid system also includes an intake manifold fluidly coupled to the fluid inlet, a fluid manifold fluidly coupled to the fluid outlet, and a fluid conduit fluidly coupled to the fluid outlet and the intake manifold. The fluid system further includes a valve fluidly coupled to the fluid conduit, the valve configured to control fluid flow through the fluid conduit, and a controller configured to position the valve in an open position or a closed position, wherein fluid is directed through the fluid conduit when the valve is in the open position and fluid is directed to the fluid manifold via the fluid outlet when the valve in in the closed position.

DETAILED DESCRIPTION

Figure 1:
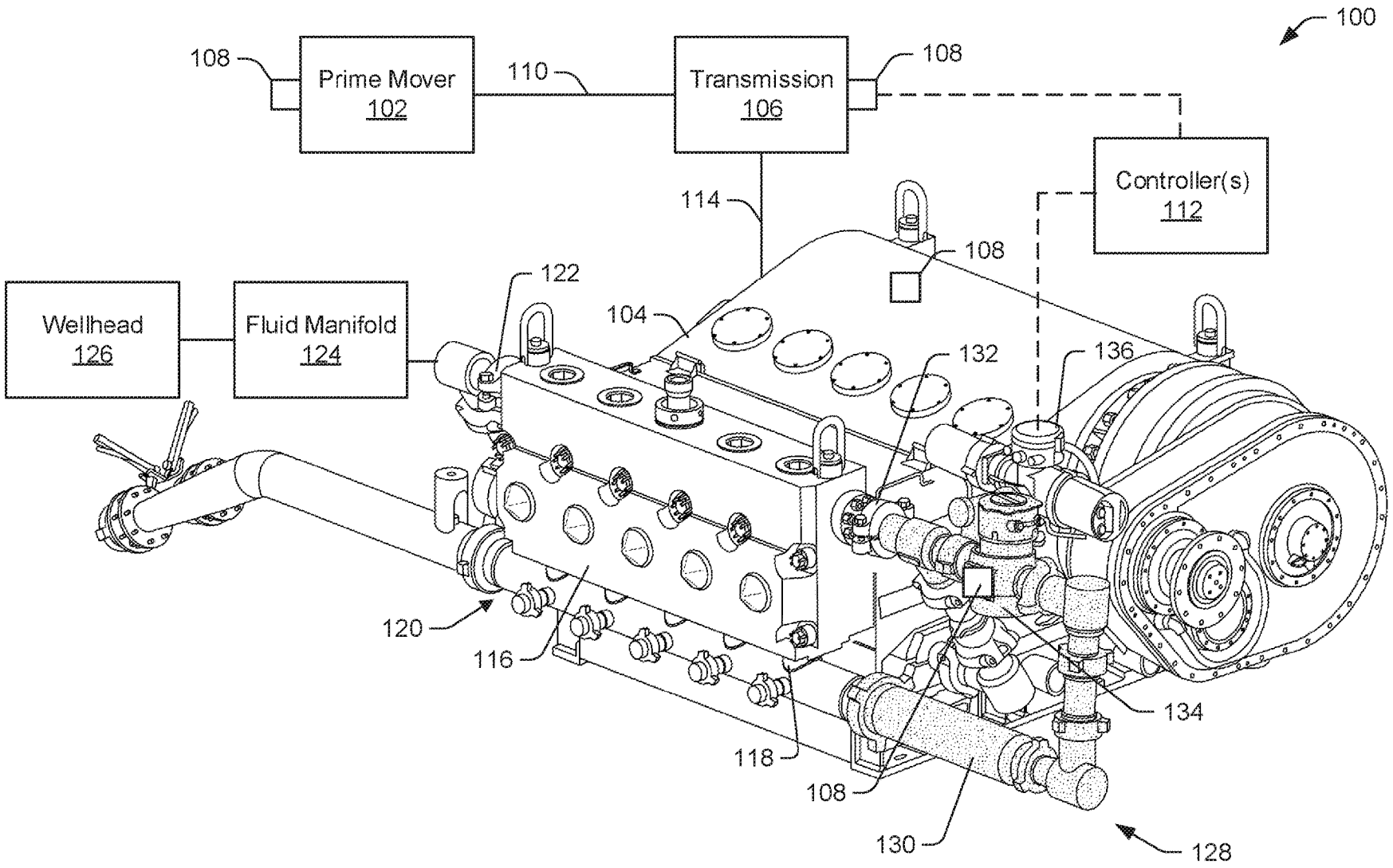
FIG. 1 is a partial schematic view of an example fluid system having an unloading system, in accordance with an example of the present disclosure.

FIG. 1 depicts an example fluid system 100. The fluid system 100 shown in FIG. 1 is part of a well service, workover, or well stimulation system for an oil and gas well. For example, the fluid system 100 is implemented in a hydraulic fracturing system, which is a well stimulation technique that involves pumping hydraulic fracturing fluid into a wellbore at a rate and pressure sufficient to form fractures in a rock formation surrounding the wellbore. In some examples, the fluid system 100 shown in FIG. 1 forms a portion of a hydraulic fracturing system or other well service system and may include additional and/or alternative components than the components shown and described in FIG. 1.

In some examples, the fluid system 100 includes at least one prime mover 102 coupled to a pump 104. The prime mover 102 is coupled to the pump 104 via a transmission 106 and is configured to drive operation of the pump 104. As such, the prime mover 102 may also be referred to herein as a "driver." In some examples, the prime mover 102 may be a diesel engine, natural gas engine, or other type of internal combustion engine. Alternatively, the prime mover 102 may be an electric motor. In some examples, the system 100 includes one or more sensors 108 that are configured to generate sensor data associated with the prime mover 102. For example, the sensors 108 may determine a speed at which a drive shaft 110 of the prime mover 102 rotates, and the sensors 108 may generate driver speed data representative of the speed of the drive shaft 110. In some examples, the sensors 108 may provide the driver speed data to a controller 112 of the fluid system 100. The one or more sensors 108 may also generate and communicate driver load data or other types of data associated with the prime mover 102 to the controller 112.

The prime mover 102 may be indirectly coupled (e.g., via the transmission 106) or directly coupled to the pump 104 and may be configured to drive the pump 104. However, in some examples, the prime mover 102 may be directly coupled to the pump 104. In either example, the prime mover 102 and/or the transmission 106 may form a powertrain of the fluid system 100. In some examples, the pump 104 may be a hydraulic fracturing pump (or other type of well service or workover pump). The pump 104 may include various types of high-volume hydraulic fracturing pumps such as triplex pumps, quintuplex pumps, or other types of hydraulic fracturing pumps. Additionally, and/or alternatively, the pump 104 includes other types of reciprocating positive-displacement pumps or gear pumps. A number of pumps implemented in the fluid system 100 and designs of the pump 104 (or pumps) may vary depending on the fracture gradient of the rock formation that will be hydraulically fractured, the number of pumps 104 used in a fluid system 100, the flow rate necessary to complete the hydraulic fracture, the pressure necessary to complete the hydraulic fracture, etc. The fluid system 100 includes any number of pumps 104 in order to pump hydraulic fracturing fluid at a predetermined rate and pressure. The exact configuration of the fluid system 100 varies from site to site.

In some examples, the sensors 108 of the fluid system 100 may generate sensor data associated with the pump 104. For example, the sensors 108 may determine a pump speed representative of a speed of a crankshaft, plunger, or other component of the pump 104. Furthermore, the sensors 108 may also generate pump load data or other types of data associated with the pump 104, and may communicate such data to the controller 112.

As mentioned previously, the prime mover 102 may be coupled indirectly to the pump 104 via the transmission 106. As such, the transmission 106 is configured to receive the drive shaft 110 of the prime mover 102. However, in some examples, the prime mover 102 may be coupled directly to the pump 104 and the transmission 106 may be omitted. In some examples, the transmission 106 receives the drive shaft which rotates at a first speed and may transfer rotational energy to an output shaft 114 of the transmission 106 that rotates at a second speed. Depending on a gear ratio (or speed ratio) of the transmission 106, the second speed may be different than the first speed. However, in some examples, the gear ratio (or speed ratio) of the transmission 106 may be selected to transfer rotational energy from the drive shaft 110 of the prime mover 102 to the output shaft 114 of the transmission 106 at a substantially similar (or same) rotational speed. In some examples, the transmission 106 may be various types of transmission. For example, the transmission 106 may include a geared transmission, hydromechanical transmission, continuously variable transmission (CVT), hydraulic parallel path transmissions having variators, or other type of transmission.

In some examples, the sensors 108 of the fluid system 100 may generate sensor data associated with the transmission 106. For example, the sensors 108 may determine a transmission state of the transmission 106 indicating whether the transmission is engaged or disengaged (e.g., in a neutral state). Furthermore, the sensors 108 may determine a gear ratio (or speed ratio) of the transmission 106 and/or may determine an input shaft (e.g., drive shaft 110) speed and/or an output shaft 114 speed. The sensors 108 may also generate other types of data associated with the transmission 106 and may communicate sensor data associated with the transmission 106 to the controller 112.

In some examples, the fluid system 100 may include multiple controllers 112 that receive data from the fluid system 100 and are configured to control at least a portion of the operations of the fluid system 100 automatically and/or with user input, as will be described further herein. While the description herein may describe a single controller 112, it is to be understood that multiple controllers 112 may be used to perform the actions described herein. As such, the multiple controllers 112 communicatively coupled to each other to coordinate operation of the fluid system 100.

In some examples, the controller 112 may be, for example, a hardware electronic control module (ECM) or other electronic control unit (ECU). The controller 112 includes, for example, a microcontroller, one or more processors, memory (e.g., RAM), storage (e.g., EEPROM or Flash) configured to perform the described functions of the controller 112. The controller 112 controls at least a portion of the operations of the fluid system 100 automatically and/or with user input. Instead of, or in addition to, an ECM/ECU the controller 112 may include a general computer microprocessor configured to execute computer program instructions (e.g., an application) stored in memory to perform the disclosed functions of the controller 112. As mentioned, the controller 112 includes a memory, a secondary storage device, processor(s), and/or any other computing components for running an application. Various other circuits may be associated with controller 112 such as power supply circuitry, signal conditioning circuitry, solenoid driver circuitry, actuator driver circuitry, or other circuitry. In some examples, the controller 112 and/or a portion of components of the controller 112 may be located remotely from the fluid system 100 and may be communicatively coupled to the fluid system 100.

As mentioned previously, the controller 112 may receive various types of data from components of the fluid system 100. Furthermore, the controller 112 may provide instructions to the various components of the fluid system 100. For example, the controller 112 may receive driver speed data from a sensor 108 of the prime mover 102 and/or may receive transmission gear ratio data, transmission state data, or other data associated with the transmission 106. The controller 112 may also provide operational instructions to the prime mover 102, and in some examples, the controller 112 may generate such instructions based on information received from the sensor 108 and/or based on other information (e.g., one or more control maps, algorithms, or rules stored in the memory noted above). In any of the examples described herein, the controller 112 may be configured to control operation of the prime mover 102 during various tasks performed by the fluid system 100. For example, the controller 112 may be configured to start up or wind down the prime mover 102.

In some examples, the pump 104 includes at least one plunger (e.g., element 200 shown and described with respect to FIG. 2) that is at least partially disposed within a fluid end 116 and is moveable within the fluid end 116. The plunger 200 is moveable within the fluid end 116 to draw fluid into the fluid end 116 via one or more fluid inlets 118 from an intake manifold 120 configured to distribute hydraulic fracturing fluid to one or more chambers within the fluid end 116. The intake manifold 120 may receive fluid from a fluid source that may include one or more water tanks, blenders, hydration units, liquid additive systems, hoppers, etc. The plunger 200 is further moveable within the fluid end 116 to displace fluid within the fluid end 116 until a pressure of the fluid within the fluid end 116 reaches and/or exceeds a threshold pressure, thereby causing fluid to flow out of a first fluid outlet 122 of the fluid end 116. In some examples, the fluid flows from the first fluid outlet 122 to a fluid manifold 124 that receives pressurized fluid from one or more fluid ends and directs the fluid to a wellhead 126 where the fluid is injected into a wellbore. Such a process of drawing fluid into the fluid end 116 and displacing fluid through the first fluid outlet 122 may be referred to herein as "normal operation" of the fluid system 100.

In some examples, the fluid system 100 further includes an unloading system 128. The unloading system 128 may be configured to allow fluid to circulate between the fluid end 116 and the intake manifold 120. For example, the unloading system 128 may include a fluid conduit 130 fluidly coupled, or connected, to the intake manifold 120 and a second fluid outlet 132 of the fluid end 116. The unloading system 128 may also include a valve 134 configured to control fluid flow through the fluid conduit 130. For example, when the valve 134 is closed, fluid is directed through the first fluid outlet 122 towards the fluid manifold 124 and the wellhead 126. However, when the valve 134 is open, fluid flows through the second fluid outlet 132 of the fluid end 116 and back to the intake manifold 120 where the fluid may be drawn into the fluid end 116 again. In some examples, the unloading system 128 may include one or more valves 134 ("the valve(s) 134") configured to control fluid flow through the fluid conduit 130. For example, the unloading system 128 may include a first valve that chokes flow through the unloading system 128 to reduce fluid energy through the fluid conduit, which may allow a second valve to close, preventing fluid flow through the fluid conduit 130.

In some examples, the valve(s) 134 may be opened while the prime mover 102 starts up, winds down, or during other operations of the prime mover 102. Operating the pump 104 while the valve(s) 134 are positioned in an open position permits fluid to circulate between the fluid end 116 and the intake manifold 120. Additionally, operating the pump 104 while the valve(s) 134 are positioned in the open position may prevent fluid flow through the first fluid outlet 122 of the fluid end 116 while the prime mover 102 starts up or winds down. The first fluid outlet 122 and the second fluid outlet 132 are fluidly coupled. In some examples, pressure differentials within the fluid system 100 may be such that when the valve(s) 134 are open, fluid flows through the second fluid outlet 132 to recirculate to the intake manifold 120 instead of flowing through the first fluid outlet 122. However, when the valve(s) 134 are closed, fluid is displaced through the first fluid outlet 122 and to the fluid manifold 124. Opening the valve(s) 134 while the prime mover 102 starts up, winds down, or otherwise operates, may reduce a load exerted on the prime mover 102 and/or the pump 104 as the prime mover 102 is brought up to speed or is wound down. Starting or winding down the prime mover 102 under a reduced load may significantly reduce fuel consumption, reduce electrical power requirements, allow the prime mover 102 to reach a rated speed and torque before being loaded, and/or may extend a life of the prime mover 102 and/or pump 104.

In some examples, the valve(s) 134 may be a plug valve, gate valve, globe valve, ball valve, or other type of valve. Furthermore, the unloading system 128 includes one or more actuators 136 ("the actuator(s) 136") coupled to the valve(s) 134 and configured to move the valve(s) 134 between an open position, a closed position, and/or intervening positions between the open position and the closed position. The actuator(s) 136 may include one or more electronic actuators, hydraulic actuators, pneumatic actuators, or other type of actuator configured to actuate the valve(s) 134.

In some examples, the unloading system 128 is communicatively coupled to the controller 112. For example, the controller 112 may be configured to control actuation of the actuator(s) 136. As such, the controller 112 may be configured to position the valve(s) 134 in an open position or a closed position via actuation of the actuator(s) 136. In some examples, the controller 112 sends one or more signals to the actuator(s) 136 which cause the actuator(s) 136 to open or close the valve(s) 134. In some examples, the controller 112 may control a closing time or an opening time for the valve(s) 134 to completely close or open in order to reduce a load imparted on the prime mover 102 as the prime mover 102 drives the pump 104. For example, the controller 112 may cause the valve(s) 134 to open or close between approximately 2 seconds and approximately 15 seconds, between approximately 3 second and approximately 10 seconds, or between approximately 4 second and approximately 7 seconds. However, it is to be understood that the controller 112 may open or close the valve(s) 134 during time intervals greater than or less than the intervals described previously. Furthermore, the controller 112 may be configured to position a first valve in a position that reduces fluid flow through the unloading system 128 and may be configured to close a second valve completely in order to prevent fluid flow through the fluid conduit 130. In some examples, reducing flow via the first valve before closing the second valve may reduce a load increase rate that is imparted on the pump 104, the prime mover 102, the valve(s) 134 themselves, or other components in the fluid system 100.

As described previously, the controller 112 receives sensor data from the one or more sensors 108 of the fluid system 100. The sensor data may be indicative of driver speed of the prime mover 102, transmission state of the transmission 106, pump load or speed of the pump 104, or indicative of other parameters of the fluid system 100. The controller 112 may be configured to control operation of the unloading system 128 based at least in part on the sensor data. For example, the controller 112 is configured to instruct the actuator(s) 136 to open the valve(s) 134 when the driver speed data indicates that the driver speed is below a threshold driver speed and/or when the transmission state indicates that the transmission is engaged. Conversely, the controller 112 may be configured to instruct the actuator(s) 136 to close the valve(s) 134 when the driver speed data indicates that the driver speed is equal to or greater than a threshold driver speed and/or when the transmission state indicates that the transmission is engaged.

In some examples, once the driver speed reaches the threshold driver speed, the prime mover 102 may be capable of driving operation of the pump 104 at a required torque, pump speed, pump rate, or other parameter. Once the controller 112 positions the valve(s) 134 in the closed position while the pump 104 is operating, the fluid system 100 may direct fluid to be discharged from the fluid end 116 via the first fluid outlet 122. However, in some examples, the controller 112 may be manually operated by a user that operates the controller 112 to control operation of the unloading system 128. Furthermore, the controller 112 may receive additional sensor data from one or more other sensors of the system 100. For example, the system 100 may receive pressure data associated with one or more components of the system, load data associated with the pump 104 and/or the prime mover 102, and/or other data associated with the system 100. The controller 112 may control operation of the unloading system 128 based at least in part on the additional sensor data in addition to or instead of the driver speed data.

As mentioned previously, the unloading system 128 may be configured to open the valve(s) 134 while the prime mover 102 starts up, winds down, or otherwise operates. However, once the prime mover 102 reaches a threshold speed, the unloading system 128 may close the valve(s) 134 which may cause the fluid system 100 to allow fluid to be discharged from the fluid end 116 via the first fluid outlet 122. According to the present disclosure, the pump 104 (e.g., including the unloading system 128) may be operated independently of system pressure (e.g., fluid pressure downstream of the pump 104). Therefore, the prime mover 102, associated with the pump 104, may be accelerated to an operating speed and operating torque against a reduced load that is less than an operating load that corresponds to system pressure. Starting or winding down the prime mover 102 under the reduced load may significantly reduce fuel consumption, reduce electrical power requirements, and/or may extend a life of the prime mover 102 and/or pump 104.

Figure 2:
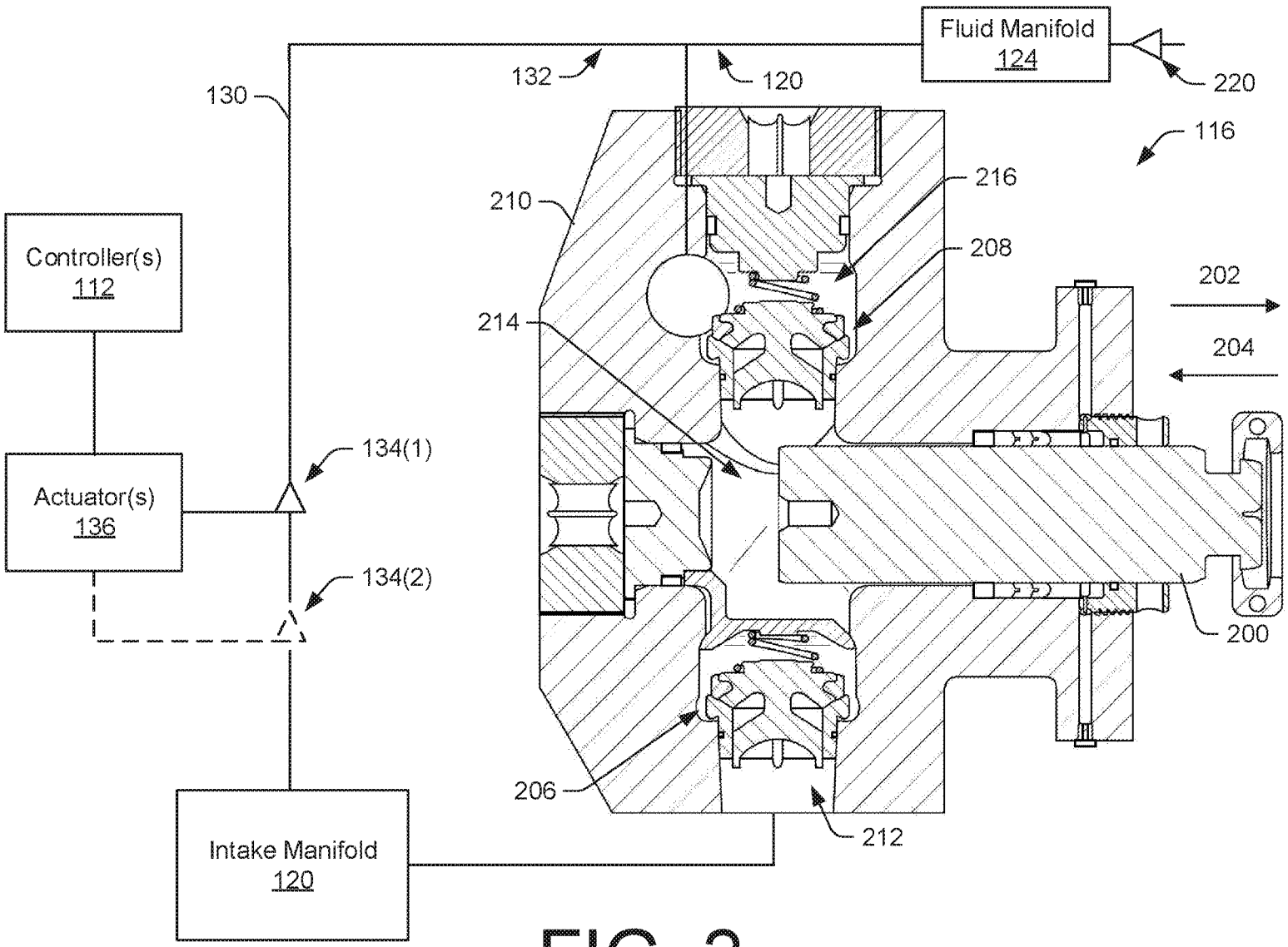
FIG. 2 is a cross-sectional schematic view of an example fluid end with an unloading system fluidly coupled thereto, in accordance with an example of the present disclosure.

FIG. 2 depicts a cross-sectional schematic view of the fluid end 116 with a schematic representation of the unloading system 128 fluidly coupled thereto. As mentioned previously, the pump 104 includes one or more plungers 200 disposed within the fluid end 116. When the pump 104 is operating, the pump 104 drives the plunger 200 in reciprocating motion. For example, the pump 104 moves the plunger 200, at least partially within the fluid end 116, in a first direction 202 and a second direction 204 that is opposite the first direction 202. In some examples, the pump 104 may be configured to move the plunger 200 in reciprocal directions in order to allow fluid into the fluid end 116 and pump the fluid out of the fluid end 116. For example, when the pump 104 moves the plunger 200 in the first direction 202, the plunger 200 allows fluid to flow through a suction valve 206 into the fluid end 116 from the intake manifold 120. The intake manifold 120 is configured to distribute hydraulic fracturing fluid to one or more chambers within the fluid end 116. The source of fluid to the intake manifold 120 may include one or more water tanks, blenders, hydration units, liquid additive systems, etc.

Furthermore, when the pump 104 moves the plunger 200 in the second direction 204, the plunger 200 displaces the fluid, increasing a pressure of the fluid, until the fluid reaches a predetermined pressure. Once the fluid reaches the predetermined pressure, a discharge valve 208 (shown further in FIG. 3) within the fluid end 116 opens and allows the fluid to move from the fluid end 116 into a fluid manifold 124. In some examples, the fluid manifold 124 receives pressurized fluid from one or more fluid ends and directs the fluid to a wellhead 126 where the fluid is injected into a wellbore.

In some examples, the fluid end 116 includes a block 210 having one or more bores (or fluid passages) formed in the block 210 of the fluid end 116. The block 210 may be formed from stainless steel, carbon steel, or other material. In some examples, the fluid end 116 includes a suction bore 212 formed in the block 210. The suction bore 212 provides a fluid passageway for fluid to enter the fluid end 116 when the plunger 200 moves in the first direction 202. The suction bore 212 includes the suction valve 206 disposed within the suction bore 212. The suction valve 206 is configured to control flow of fluid into the fluid end 116. For example, when the plunger 200 moves in the first direction 202, the movement of the plunger 200 causes the pressure of the fluid in a pump chamber 214 to be lower than the pressure of the fluid in the suction bore 212 which causes the suction valve 206 to open, thereby allowing fluid into the fluid end pump chamber 214. Conversely, when the plunger 200 moves in the second direction 204, the suction valve 206 remains closed, allowing the plunger 200 to displace the fluid within the fluid end 116.

The fluid end 116 also includes a discharge bore 216 formed in the block 210. The discharge bore 216 provides a fluid passageway for fluid to be discharged from the fluid end 116 to the fluid discharge manifold 124 or to the unloading system 128 depending upon the position of the valve(s) 134. The discharge bore 216 includes a discharge valve 208 disposed within the discharge bore 216. The discharge valve 208 is configured to control fluid flow from the fluid end 116. For example, the discharge valve 208 remains closed until the fluid has reached a predetermined pressure as the plunger 200 displaces the fluid by moving in the second direction 204. Once the fluid reaches the predetermined pressure, the pressurized fluid causes the discharge valve 208 to open, allowing the fluid to be discharged from the fluid end 116.

The fluid end 116 further includes a plunger bore 218 formed in the block 210. The plunger bore 218 is sized to receive the plunger 200 of the pump 104 at least partially therein. As mentioned previously, the plunger 200 is moveable in the first direction 202 and the second direction 204 within the plunger bore 218 to allow fluid into the fluid end 116 via the suction bore 212 and discharge the fluid from the fluid end 116 via the discharge bore 216.

The fluid end 116 also includes a pump chamber 214 disposed between the suction bore 212 and the discharge bore 216. The pump chamber 214 is a chamber formed in the fluid end 116 that is formed at least in part by a convergence of portion(s) of the suction bore 212, the discharge bore 216, the plunger bore 218, and the suction cover bore 138. In some examples, the plunger 200 displaces the fluid in the pump chamber 214 until it reaches a predetermined pressure, which causes the discharge valve 208 to open, allowing the fluid to exit the pump chamber 214 via the discharge valve 208.

The fluid system 100 further includes an unloading system 128. The unloading system 128 may be configured to maintain the valve(s) 134 in an open position while the prime mover 102 starts up, winds down, or otherwise operates. Opening the valve(s) 134 while the prime mover 102 starts up, winds down, or otherwise operates, may reduce a load exerted on the prime mover 102 and/or the pump 104 as the prime mover 102 is brought up to speed or is wound down. Starting or winding down the prime mover 102 under a reduced load may significantly reduce fuel consumption, reduce electrical power requirements, allow the prime mover 102 to reach a rated speed and torque before being loaded, and/or may extend a life of the prime mover 102 and/or pump 104. In some examples, the unloading system 128 includes multiple valves. For example, the unloading system 128 may include a first valve 134(1) that may be positioned to choke flow through the unloading system 128 to reduce fluid energy through the fluid conduit 130. Reducing fluid flow through the fluid conduit 130 may allow a second valve 134(2) to completely close under reduced fluid flow, preventing fluid flow through the fluid conduit 130. In such a configuration, the first valve 134(1) is disposed upstream of the second valve 134(2).

As mentioned previously, pressure differentials within the fluid system 100 may be such that when the valve(s) 134 are open, fluid flows through the fluid flows through the second fluid outlet 132 to recirculate to the intake manifold 120 instead of flowing through the first fluid outlet 122. However, when the valve(s) 134 are closed, fluid is displaced through the first fluid outlet 122 and to the fluid manifold 124. In some examples, the fluid system 100 may include another valve 220 that may be opened or closed in order to direct flow to the fluid manifold 124 or back to the intake manifold 120. Operation of the valve 220 may be controlled by the controller 112 in a similar manner as the valve(s) 134.

In some examples, the controller 112 receives driver speed data from the one or more sensors 108 of the prime mover 102. The sensor data may include driver speed data that is indicative of a driver speed (e.g., engine or motor speed) of the prime mover 102. The controller 112 may be configured to control operation of the unloading system 128 based at least in part on the driver speed data. For example, the controller 112 may be configured to open the valve(s) 134 when the driver speed data indicates that the driver speed is below a threshold driver speed. However, in some examples, the controller 112 is configured to position the valve(s) in an open position or a closed position irrespective of the driver speed and/or in combination with sensor data received from the transmission 106 that may indicate a state or a gear ratio of the transmission 106. Furthermore, the controller 112 may be configured to position one or more of the valve(s) 134 in a partially open and/or partially closed position to reduce an amount of fluid flow through the fluid conduit 130. In some examples, once the controller 112 positions one of the valves in a partially opened or partially closed position to reduce an amount of fluid flow through the fluid conduit 130, the controller 112 may completely close the other valve. In some examples, while the controller 112 is described as positioning the valve(s) 134 in the open position or the closed position, it is to be understood that a user may manually control such operations.

In some instances, when the driver speed is below a threshold driver speed, the prime mover 102 may be starting up or winding down. As such, the controller 112 may open the valve(s) 134 in order to unload the pump 104. For example, opening the valve(s) 134 while the prime mover 102 starts up or winds down allows the prime mover 102 to start or wind down under a reduced load. In other words, rather than having to pump fluid to a predetermined pressure to discharge fluid through the discharge valve 208, the fluid is circulated between the pump chamber 214 and the intake manifold 120. In some examples, the controller 112 may open the valve(s) 134 for an amount of time associated with a time between starting the prime mover 102 and the driver speed of the prime mover 102 reaching the threshold driver speed. The amount of time may be between approximately 1 seconds and approximately 20 seconds, between approximately 2 seconds and approximately 15 seconds, or between approximately 3 seconds and approximately 10 seconds. However, in some examples, the controller 112 may open the valve(s) for an amount of time that is greater than or less than the ranges described previously. In any example, the amount of time may be dependent upon the sensor data and various determinations made by the controller as described further herein.

In some examples, the controller 112 is configured to close the valve(s) 134 when the sensor data indicates that the driver speed is substantially equal to or greater than the threshold driver speed and/or when the sensor data indicates that the transmission 106 is engaged. In some instances, once the driver speed reaches the threshold driver speed and/or the transmission 106 is engaged, the prime mover 102 may be capable of driving operation of the pump 104 at a required torque, pump speed, pump rate, or other parameter. Once the controller 112 closes the valve(s) 134 while the pump 104 is operating, the fluid system 100 may resume "normal operation." For example, under "normal operation" when the pump 104 moves the plunger 200 in the first direction 202, the pressure in the pump chamber 214 may become lower than the pressure of the fluid in the intake manifold 120, which causes the suction valve 206 to open allowing fluid through the suction valve 206 into the fluid end 116 from the intake manifold 120. When the plunger 200 begins to move in the second direction 204, the suction valve 206 may close, preventing fluid from returning through the suction bore 212. As such, the actuator(s) 136 may be configured to close the valve(s) 134 such that the fluid system 100 is able to resume "normal operation" unimpeded by the unloading system 128.

Additionally, or alternatively, the controller 112 may open the valve(s) 134 once the driver speed of the prime mover 102 is below the threshold driver speed and the amount of time is a time between the driver speed passing below the threshold driver speed and the driver speed reaching a driver speed of approximately 0 revolutions per minute (RPM) (or other secondary threshold speed). Starting or winding down the prime mover 102 under a reduced load may significantly reduce fuel consumption, reduce electrical power requirements, allow the prime mover 102 to reach a rated speed and torque before being loaded, and/or may extend a life of the prime mover 102 and/or pump 104.

Figure 3:
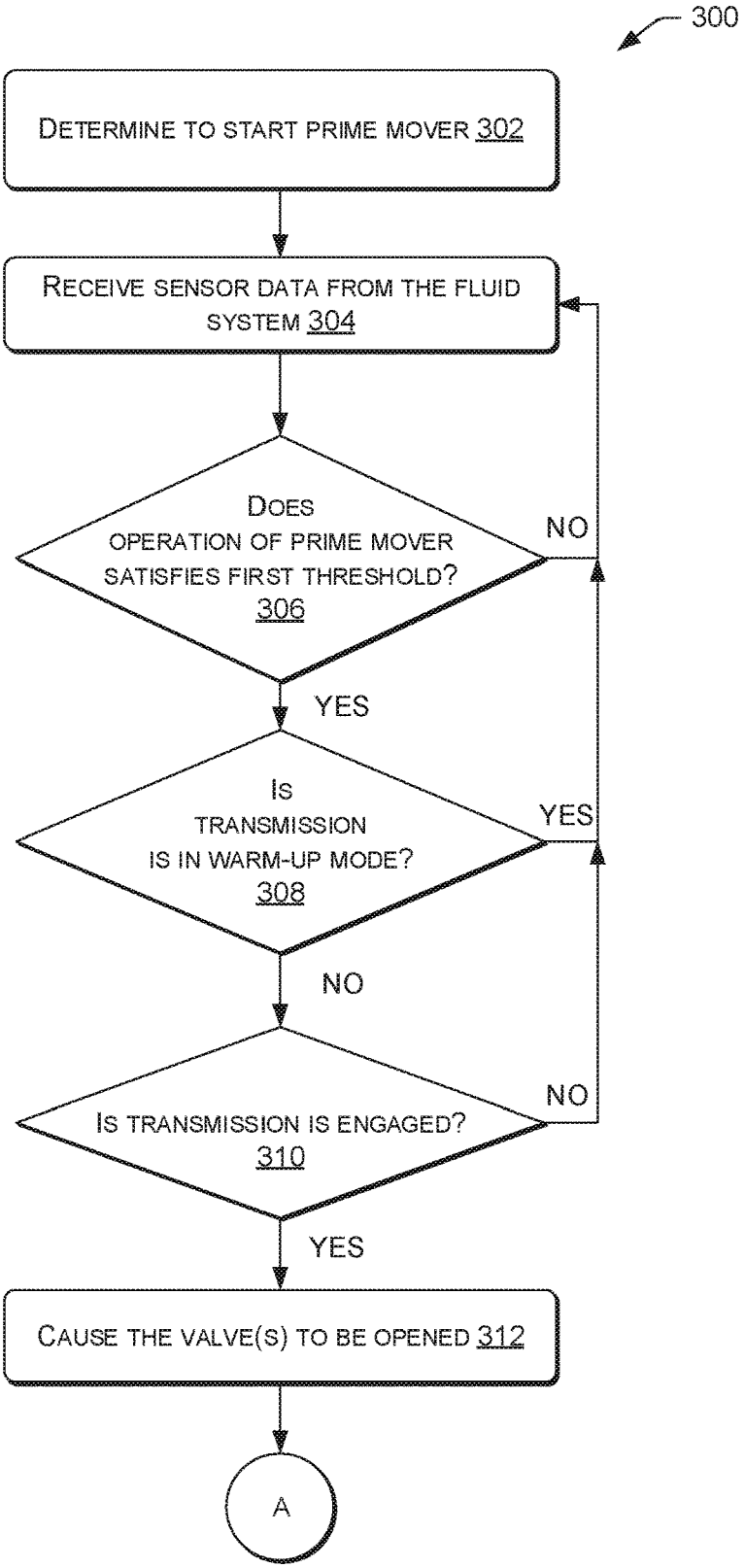
FIG. 3 is a flowchart illustrating a method of unloading a well stimulation pump, in accordance with an example of the present disclosure.

FIG. 3 illustrates an exemplary method 300 for unloading a prime mover 102 configured to drive operation of a pump 104. The example method is illustrated as a collection of steps in a logical flow diagram, which represents operations that may be implemented in hardware, software, or a combination thereof. In the context of software, the steps represent computer-executable instructions stored in memory. Such computer-executable instructions may include routines, programs, objects, components, data structures, and the like that perform particular functions or implement particular abstract data types. The order in which the operations are described is not intended to be construed as a limitation, and any number of the described steps may be combined in any order and/or in parallel to implement the process. For discussion purposes, and unless otherwise specified, the method 300 is described with reference to the system 100, the prime mover 102, the pump 104, the one or more sensors 108, the controller 112, the fluid end 116 and the components thereof, and the unloading system 128 (including the first valve 134(1) and/or the second valve 134(2)). In particular, and unless otherwise specified, the method 300 will be described below as being performed by the controller 112 for ease of description. Additionally, and/or alternatively, at least a portion of the method 300 may be performed by user input via the controller 112 and/or one or more user interfaces included on various components of the system 100.

With reference to FIG. 3, at 302, the method 300 includes determining to start the prime mover 102. In some examples, a user may determine to start the prime mover 102 and may cause the prime mover 102 to start up. Additionally, or alternatively, the controller 112 (or another controller of the fluid system 100 such as a dedicated prime mover ECM, ECU, or other controller) receives instructions to start the prime mover 102. In some examples, a user may provide user input via a switch, user interface, or other selectable control that provides instructions to the controller 112 to start the prime mover 102. Additionally, or alternatively, the controller 112 may receive instructions to start the motor from a computing device that is configured to control at least a portion of a hydraulic fracturing process.

At 304, the controller 112 receives sensor data from the fluid system 100. For example, the controller 112 may receive sensor data form the one or more sensors 108 of the fluid system 100. The sensor data may be indicative of driver speed data from the one or more sensors 108 of the prime mover 102. In some examples, the driver speed data represents a rotational speed of the drive shaft 110 of the prime mover 102 and may be represented in revolutions per minute (RPM). Additionally, or alternatively, the sensor data may be associated with the pump 104 and may be indicative of a pump speed representative of a speed of a crankshaft, plunger, or other component of the pump 104. Furthermore, the sensors 108 may also generate and communicate pump load data or other types of data associated with the pump 104 to the controller 112. Additionally, or alternatively, in some examples, the sensor data may be associated with the transmission 106. For example, the sensors 108 may determine a transmission state of the transmission 106 indicating whether the transmission is engaged or disengaged (e.g., in a neutral state). Furthermore, the sensors 108 may determine a gear ratio (or speed ratio) of the transmission 106 and/or may determine an input shaft (e.g., drive shaft 110) speed and/or an output shaft 114 speed. The sensors 108 may also generate other types of data associated with the transmission 106 and may communicate sensor data associated with the transmission 106 to the controller 112. However, in some examples, the one or more signals represent one or more parameters associated with vibration (associated with the fluid end 116, the pump 104, and/or the prime mover 102), pressure (associated with the fluid end 116 and/or the pump 104), or one or more other parameters associated with the fluid system 100.

At 306, the controller 112 determines whether operation of the prime mover 102 satisfies a first threshold. For example, the controller 112 may determine whether the prime mover 102 is starting up and whether the driver speed of the prime mover 102 is substantially equal to or greater than a first threshold driver speed. Determining that the driver speed is substantially equal to or greater than the first threshold driver speed may indicate that the prime mover 102 has reached an "idle speed" or other threshold driver speed that may be less than a operating speed of the prime mover 102.

As described herein, "substantially equal to" may mean that the driver speed is within: approximately 50 RPM of the threshold driver speed, approximately 100 RPM of the threshold driver speed, approximately 250 RPM of the threshold driver speed, or approximately 500 RPM of the threshold driver speed. However, the above ranges are merely given as examples and "substantially equal" may include driver speed greater than or less than the above described ranges. Additionally, and/or alternatively, the controller 112 may determine, at 306, whether one or more of the parameters previously mentioned (e.g., vibration, pressure, or other parameters) satisfy a threshold value. In some examples, the controller 112 may determine whether multiple parameters satisfy multiple respective thresholds and may control operation (either automatically, semi-automatically, or manually via user input) of the unloading mechanism based on determining whether the multiple parameters satisfy their respective threshold values.

If the controller 112 determines at 306 that operation of the prime mover 102 does not satisfy the first threshold (Step: 306—No), the process 300 returns to 304 and the controller 112 continues to receive sensor data. In some examples, when the controller 112 determines that certain criteria is not met (e.g., steps 306-310), the controller 112 may maintain a current position of the valve(s) 134. The controller 112 may continue to receive sensor data, at 304, and determine whether operation of the prime mover 102 satisfies the first threshold, at 306.

If, however, the controller 112 determines at 306 that operation of the prime mover 102 satisfies the first threshold (Step: 306—Yes), the process 300 proceeds to 308 where the controller 112 determines whether the transmission 106 is in a warm-up mode. In some examples, the transmission 106 may operate for an amount of time before the transmission 106 may operate under normal operating conditions. As such, the controller 112 may determine, based at least in part on the sensor data, whether the transmission is in a warm-up mode.

If the controller 112 determines at 308 that the transmission is in a warm-up mode (Step: 308—Yes), the process 300 returns to 304 and the controller 112 continues to receive sensor data. If, however, the controller 112 determines at 308 that the transmission is not in warm-up mode (Step: 308—No), the process 300 continues to 310 where the controller 310 determines whether the transmission 106 is engaged. In some examples, when the prime mover 102 satisfies the first threshold, but has not satisfies a second threshold (described further herein), the transmission 106 may be engaged, but the transmission 106 may only be engaged in certain gear ratios (or speed ratios). For example, the controller 112 may allow the transmission 106 to be engaged in a first gear ratio (or comparable speed ratio), but may prevent the transmission 106 to be engage in other gear ratios.

If the controller determines at 310 that the transmission is disengaged (Step: 310—No), the process returns to 304 and the controller 112 continues to receive sensor data. If, however, the controller 112 determines at 310 that the transmission is engaged (Step: 310—Yes), the process 300 to 312 where the controller 112 causes the valve(s) 134 to be opened. In some examples, causing the valve(s) 134 to be opened includes sending, via the controller 112, one or more signals to the actuator(s) 136 which positions the valve(s) 134 in an open position. In some examples, the controller 112 sends the one or more signals to the actuator(s) 136 automatically (or apart from user input). However, in some examples, a user may operate or otherwise provide input to the controller 112 which causes the actuator(s) 136 to open the valve(s) 134. In either example, the controller 112 may cause the actuator(s) 136 to open the valve(s) 134. In some examples, as the valve(s) 134 are opened, the controller 112 may prevent the transmission 106 from changing gears (or speed ratios).

Figure 4:
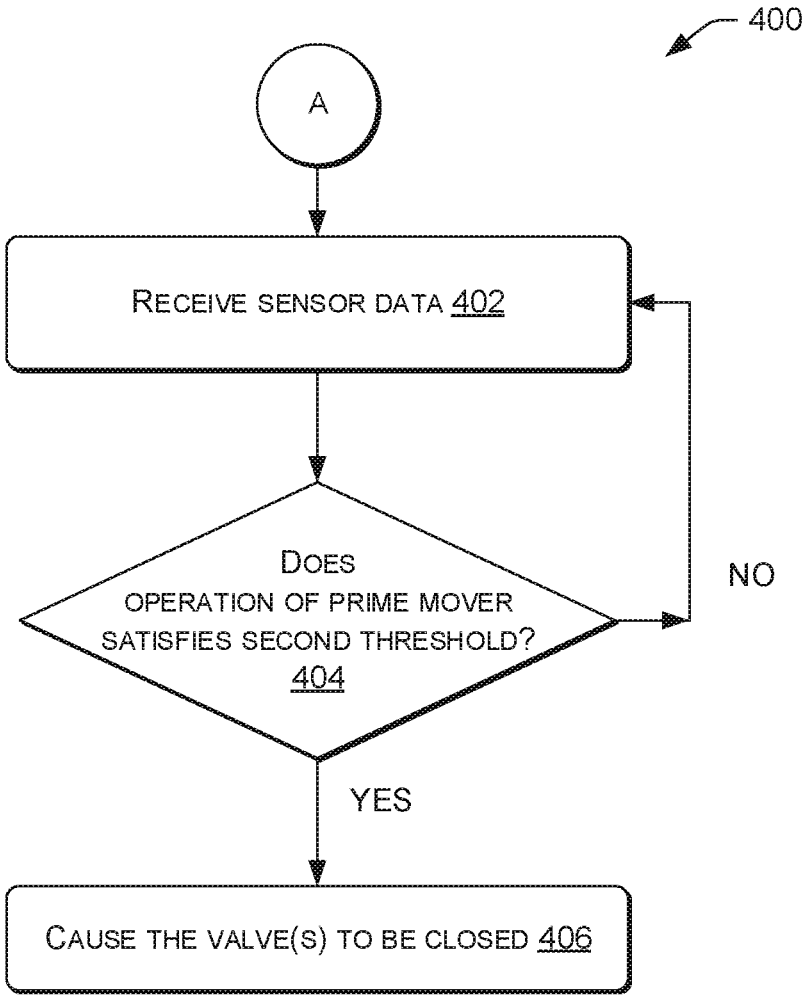
FIG. 4 is a continuation of the flowchart shown in FIG. 3 and associated with the example method of unloading a well stimulation pump, in accordance with an example of the present disclosure.

The flow diagram 400 in FIG. 4 continues the illustration of the method 300. At 402, the controller 112 continues to receive sensor data from the one or more sensors 108 of the fluid system 100. At 404, the controller 112 determines whether operation of the prime mover 102 satisfies a second threshold. For example, the controller 112 may determine whether the prime mover 102 is starting up and whether the driver speed of the prime mover 102 is substantially equal to or greater than a second threshold driver speed. Determining that the driver speed is substantially equal to or greater than the second threshold driver speed may indicate that the prime mover 102 has reached an operational speed of the prime mover 102 that may be greater than an idle speed (e.g., the first threshold) of the prime mover 102. Additionally, and/or alternatively, the controller 112 may determine, at 404, whether one or more of the parameters previously mentioned (e.g., vibration, pressure, or other parameters) satisfy a threshold value. In some examples, the controller 112 may determine whether multiple parameters satisfy multiple respective thresholds and may control operation (either automatically, semi-automatically, or manually via user input) of the unloading mechanism based on determining whether the multiple parameters satisfy their respective threshold values.

If the controller 112 determines at 404 that operation of the prime mover 102 does not satisfy the second threshold (Step: 404—No), the process 400 returns to 402 and the controller 112 continues to receive sensor data. In some examples, when the controller 112 determines that certain criteria is not met (e.g., step 404), the controller 112 may maintain a current position of the valve(s) 134. The controller 112 may continue to receive sensor data, at 402, and determine whether operation of the prime mover 102 satisfies the second threshold, at 404.

If, however, the controller 112 determines at 404 that operation of the prime mover 102 satisfies the second threshold (Step: 404—Yes), the process 400 proceeds to 406 where the controller 112 causes the valve(s) 134 to be closed. In some examples, causing the valve(s) 134 to be closed includes sending, via the controller 112, one or more signals to the actuator(s) 136 which positions the valve(s) 134 in the closed position. In some examples, the controller 112 sends the one or more signals to the actuator(s) 136 automatically (or apart from user input). However, in some examples, a user may operate or otherwise provide input to the controller 112 which causes the actuator(s) 136 to close the valve(s) 134. In either example, the controller 112 may cause the actuator 136 to close the valve(s) 134. In some examples, as the valve(s) 134 are closed, the controller 112 may prevent the transmission 106 from changing gears (or speed ratios). Furthermore, at 406, the controller 112 may cause the first valve 134(1) to be partially closed (or partially open) in order to reduce fluid flow through the fluid conduit 130 and may cause the second valve 134(2) to close once fluid flow has been reduced by the first valve 134(1).

Figure 5:
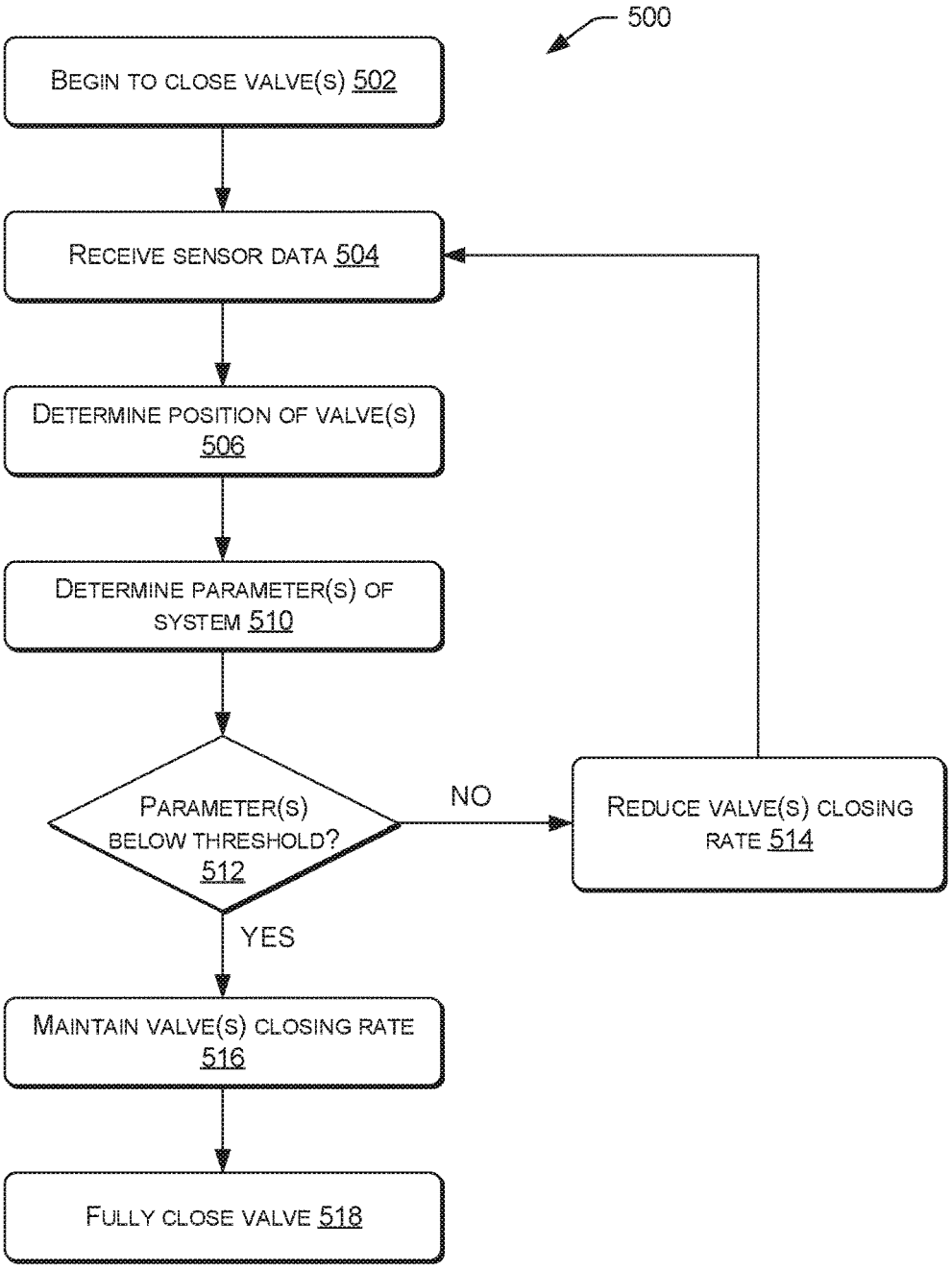
FIG. 5 is a flowchart illustrating a method of determining a closing rate for a valve of an unloading system, in accordance with an example of the present disclosure.

FIG. 5 illustrates an exemplary method 500 for determining a closing rate for the valve(s) 134 of the unloading system 128. The example method is illustrated as a collection of steps in a logical flow diagram, which represents operations that may be implemented in hardware, software, or a combination thereof. In the context of software, the steps represent computer-executable instructions stored in memory. Such computer-executable instructions may include routines, programs, objects, components, data structures, and the like that perform particular functions or implement particular abstract data types. The order in which the operations are described is not intended to be construed as a limitation, and any number of the described steps may be combined in any order and/or in parallel to implement the process. For discussion purposes, and unless otherwise specified, the method 500 is described with reference to the system 100, the prime mover 102, the pump 104, the one or more sensors 108, the controller 112, the fluid end 116 and the components thereof, and the unloading system 128 (including the first valve 134(1) and/or the second valve 134(2)). In particular, and unless otherwise specified, the method 500 will be described below as being performed by the controller 112 for ease of description. Additionally, and/or alternatively, at least a portion of the method 500 may be performed by user input via the controller 112 and/or one or more user interfaces included on various components of the system 100.

With reference to FIG. 5, at 502, the method 500 includes beginning to close the valve(s) 134. In some examples, Step 502 of the method 500 may be a continuation of the process shown and described in FIGS. 3-4. For example, Step 502 may be a continuation of Step 406 where the controller causes the valve(s) 134 to be closed. Additionally, or alternatively, in some examples, the controller 112 may receive an indication that the valve(s) 134 is beginning to close and the controller 112 may begin to close the valve(s) 134 independent of the process shown and described in FIGS. 3-4.

At 504, the controller 112 receives sensor data from the fluid system 100. For example, the controller 112 may receive sensor data form the one or more sensors 108 of the fluid system 100. The sensor data may be indicative of driver speed data from the one or more sensors 108 of the prime mover 102. In some examples, the driver speed data represents a rotational speed of the drive shaft 110 of the prime mover 102 and may be represented in revolutions per minute (RPM). The sensor data may also include load data associated with the prime mover 102. For example, the load data may include a torque and/or force that is exerted on the prime mover 102 as the prime mover 102 operates.

Additionally, or alternatively, the sensor data may be associated with the pump 104 and may be indicative of a pump speed representative of a speed of a crankshaft, plunger, or other component of the pump 104. Furthermore, the sensors 108 may also generate and communicate pump load data or other types of data associated with the pump 104 to the controller 112. For example, the sensor data may include a pump discharge pressure that is indicative of a fluid pressure of the fluid downstream of the fluid end 116. Furthermore, the sensor data may include pump load data indicative of a force exerted on the pump 104 as the pump 104 operates.

Additionally, or alternatively, in some examples, the sensor data may be associated with the transmission 106. For example, the sensors 108 may determine a transmission state of the transmission 106 indicating whether the transmission is engaged or disengaged (e.g., in a neutral state). Furthermore, the sensors 108 may determine a gear ratio (or speed ratio) of the transmission 106 and/or may determine an input shaft (e.g., drive shaft 110) speed and/or an output shaft 114 speed. The sensors 108 may also generate other types of data associated with the transmission 106 and may communicate sensor data associated with the transmission 106 to the controller 112.

Furthermore, the sensor data may be associated with the unloading system 128. For example, the sensor data may be indicative of a fluid pressure within the fluid conduit 130. Furthermore, the sensor data may be indicative of a fluid velocity across the valve(s) 134. However, in some examples, the sensor data may represent one or more parameters associated with vibration (associated with the fluid end 116, the pump 104, and/or the prime mover 102), pressure (associated with the fluid end 116 and/or the pump 104), or one or more other parameters associated with the fluid system 100.

At 506, the controller 112 determines a valve position of the valve(s). The controller 112 determines a valve position of the valve(s) 134 based at least in part on the sensor data that is received at 504. In some examples, the valve position may indicate a position of the valve(s) 134 relative to a closed and/or open position. For example, the valve position may indicate that the valve(s) 134 are 5% closed and/or 95% open. However, the valve position may be determined with respect to degrees relative to an open and/or closed position and/or with respect to a size of an opening of the valve(s) through which the fluid is able to flow.

At 508, the controller 112 determines one or more parameters of the fluid system 100. In some examples, the controller 112 determines the one or more parameters based at least in part on the sensor data received at 504 and/or the valve position determined at 506. For example, the controller 112 may determine one or more parameter(s) associated with the prime mover 102. In some examples, the controller 112 may determine a load exerted on the prime mover 102 which may include a torque and/or force that is exerted on the prime mover as the prime mover 102 operates. The controller 112 may determine a current load exerted on the prime mover 102 and/or a predicted load exerted on the prime mover based at least in part on the sensor data and/or the valve position. In some examples, the controller 112 may determine a load exerted on the prime mover 102 compared to the valve position over time and the controller 112 may extrapolate the load versus the valve position to predict the load exerted on the prime mover 102. In some examples, the controller 112 may rely on one or more data maps, look-up tables, neural networks, algorithms, machine learning algorithms, one or more models, data layers, predictive layers, and/or other components relating to operating conditions and the fluid system 100 that may be stored in the memory of the controller 112. Furthermore, in some examples, the controller 112 may determine a rate at which the load imparted on the prime mover 102 is changing (e.g., increasing or decreasing) based at least in part on the current load, the load over time, and/or the predicted load.

Furthermore, in some examples, the controller 112 may determine one or more parameter(s) associated with the pump 104. For example, the controller 112 may determine a pump discharge pressure that is indicative of a fluid pressure of the fluid downstream of the fluid end 116. In some examples, the controller 112 may determine a current pump load, a predicted pump load, a current discharge pressure, and/or a predicted discharge pressure. In some examples, the controller 112 may determine a pump load and/or pump discharge pressure compared to the valve position over time and the controller 112 may extrapolate the pump load and/or pump discharge pressure verses the valve position to predict the pump load and/or the pump discharge pressure. In some examples, the controller 112 may rely on one or more data maps, look-up tables, neural networks, algorithms, machine learning algorithms, one or more models, data layers, predictive layers, and/or other components relating to operating conditions and the fluid system 100 that may be stored in the memory of the controller 112. Furthermore, in some examples, the controller 112 may determine a rate at which the pump load and/or pump discharge pressure is changing (e.g., increasing or decreasing) based at least in part on the current pump load and/or pump discharge pressure, pump load and/or pump discharge pressure over time, and/or the predicted pump load and/or predicted pump discharge pressure.

Furthermore, in some examples, the controller 112 may determine a pump speed representative of a speed of a crankshaft, plunger, or other component of the pump 104. Additionally, or alternatively, in some examples, the controller 112 may also determine a volumetric flow rate of fluid flowing through the valve(s) 134 and/or a fluid velocity of fluid across the valve(s) 134. In some examples, the controller 112 determines a current volumetric flow rate of fluid flowing through the valve(s) 134, current a fluid velocity of fluid across the valve(s) 134, a predicted volumetric flow rate of fluid flowing through the valve(s) 134, and/or a fluid velocity of fluid across the valve(s) 134. The controller 112 may rely on one or more data maps, look-up tables, neural networks, algorithms, machine learning algorithms, one or more models, data layers, predictive layers, and/or other components relating to operating conditions and the fluid system 100 that may be stored in the memory of the controller 112. Furthermore, in some examples, the controller 112 may determine a rate at which the volumetric flow rate and/or the fluid velocity is changing (e.g., increasing or decreasing).

At 512, the controller 112 determines whether the one or more parameters determined at 510 are below a threshold. For example, the controller 112 may determine whether the prime mover load is below a predetermined threshold. In some examples, determining whether the prime mover load is below the predetermined threshold may include determining whether: a current prime mover load is below a predetermined threshold, a predicted prime mover load is below a predetermined threshold, and/or a prime mover load change rate (e.g., increasing prime mover load or decreasing prime mover load) is below a predetermined threshold.

Additionally, or alternatively, in some examples, the controller 112 may determine whether a pump load is below a predetermined threshold. For example, determining whether the pump load is below the predetermined threshold may include determining whether: a current pump load is below a predetermined threshold, a predicted pump load is below a predetermined threshold, and/or a pump load change rate (e.g., increasing pump load or decreasing pump load) is below a predetermined threshold. Additionally, or alternatively, the controller 112 may determine whether the pump discharge pressure is below a predetermined threshold. Determining whether the pump discharge pressure is below the predetermined threshold may include determining whether: a current pump discharge pressure is below a predetermined threshold, a predicted pump discharge pressure is below a predetermined threshold, and/or a pump discharge pressure change rate (e.g., increasing pump discharge pressure or decreasing pump discharge pressure) is below a predetermined threshold.

Additionally, or alternatively, in some examples, the controller 112 may determine whether a volumetric flow rate of fluid flowing through the valve(s) 134 and/or a fluid velocity of fluid across the valve(s) 134 is below a predetermined threshold. determining whether the volumetric flow rate of fluid flowing through the valve(s) 134 and/or the fluid velocity of fluid across the valve(s) 134 is below a predetermined threshold may include determining whether: a current volumetric flow rate and/or a current fluid velocity is below a predetermined threshold, a predicted volumetric flow rate and/or a predicted fluid velocity, and/or a volumetric flow change rate and/or a fluid velocity change rate (e.g., increasing volumetric flow and/or increasing fluid velocity or decreasing volumetric flow and/or decreasing fluid velocity) is below a predetermined threshold.

If the controller 112 determines at 512 that the one or more parameters are not below a threshold (Step: 512—No), the process continues to 514 where the controller 112 reduces the closing rate of the valve(s) 134. Reducing the closing rate of the valve(s) 134 may ensure that a load imparted on the prime mover 102, the pump 104, and/or the transmission 106, does not increase too quickly as the valve(s) 134 close. Once the controller 112 reduces the closing rate of the valve(s) 134, the process 500 returns to 504 where the controller 112 receives sensor data and the controller 112 may continue to monitor the parameter(s) of the system 100 to determine whether the parameter(s) are below the predetermined threshold.

If, however, the controller 112 determines at 512 that the one or more parameters are below the threshold (Step: 512—Yes), the process continues to 516 where the controller 112 maintains the closing rate 516 of the valve(s) 134. At 518, the controller 112 fully closes the valve(s) 134 and the system 100 may continue to operate.

INDUSTRIAL APPLICABILITY

The present disclosure provides a system and mechanism for unloading a pump during start up or wind down of a prime mover that drives the pump. The system can be used in a variety of applications. For example, the system is used in gas, oil, and hydraulic fracturing applications. The system includes an unloading system that provides a fluid conduit fluidly connecting a fluid end to an intake manifold allowing fluid to circulate therebetween when one or more valves are opened. Starting or winding down the prime mover with the valve(s) open reduces a load imparted on the prime mover as the prime mover drives the pump. Furthermore, starting or winding down the prime mover under a reduced load can significantly reduce fuel consumption, reduce electrical power requirement and/or can extend a life of the prime mover and/or the pump.

According to some embodiments, the system 100 includes a controller 112 configured to position one or more valves 134 in an open position or a closed position. The controller 112 positions the valve(s) 134 in the open position or the closed position while a prime mover 102 and a pump 104 are operating. The controller 112 is communicatively coupled to an unloading system 128 that positions the valve(s) 134 in a position. The unloading system 128 includes one or more actuators 136 that move the valve(s) 134 between various positions. The controller 112 is configured to position the valve(s) 134 in the open position when the driver speed is below a threshold driver speed and/or when a transmission 106 is engaged. The controller is further configured to position the suction valve in the closed position when the driver speed is substantially equal to or greater than the threshold driver speed and/or when the transmission 106 is engaged. Starting or winding down the prime mover 102 under a reduced load may significantly reduce fuel consumption, reduce electrical power requirements, allow the prime mover 102 to reach a rated speed and torque before being loaded, and may extend a life of the prime mover 102 and/or pump 104, among other potential benefits.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A system, comprising:

a fluid end including a block having a fluid inlet and a fluid outlet;

an intake manifold fluidly coupled to the fluid inlet of the block;

a fluid conduit fluidly coupled to each of the fluid outlet of the block and the intake manifold;

a valve fluidly coupled to the fluid conduit, the valve configured to control fluid flow through the fluid conduit;

an actuator coupled to the valve and configured to transition the valve to an open position or a closed position;

a prime mover configured to rotate a drive shaft;

a pump having a plunger disposed at least partially within the block of the fluid end, the pump being coupled to the drive shaft of the prime mover via a transmission, the transmission configured to transfer rotational energy from the drive shaft to the pump;

one or more sensors configured to generate sensor data associated with at least one of the prime mover, the pump, or the transmission, the sensor data including at least one of:

driver speed data indicative of a driver speed of the prime mover, or transmission data indicative of a transmission state; and a controller communicatively coupled to the actuator and the one or more sensors, the controller configured to:

receive the sensor data from the one or more sensors, determine, based at least in part on the sensor data, whether the driver speed is:

less than a threshold driver speed, or equal to or greater than the threshold driver speed, determine, based at least in part on the sensor data, whether the transmission is engaged or disengaged, and cause the actuator to transition the valve to the open position, based at least in part on determining that the driver speed is less than the threshold driver speed and determining that the transmission is engaged.

2. The system of claim 1, wherein the controller is further configured to:

cause the actuator to transition the valve to the closed position, based at least in part on determining that the driver speed is equal to or greater than the threshold driver speed and determining that the transmission is engaged.

3. The system of claim 1, wherein the controller is further configured to:

maintain a current valve position, based at least in part on determining that the transmission is disengaged.

4. The system of claim 1, wherein the actuator transitions the valve to the open position or the closed position during a predetermined amount of time in order to reduce a rate of load on the prime mover driving operation of the pump.

5. The system of claim 1, wherein fluid circulates between the fluid outlet and the intake manifold when the pump is operating with the valve in the open position.

6. The system of claim 2, wherein fluid is directed only to a fluid manifold, via the fluid outlet, when the pump is operating with the valve in the closed position.

7. A fluid system comprising:

a fluid end including a block having a fluid inlet and a fluid outlet;

an intake manifold fluidly coupled to the fluid inlet;

a fluid manifold fluidly coupled to the fluid outlet;

a fluid conduit fluidly coupled to the fluid outlet and the intake manifold;

a valve fluidly coupled to the fluid conduit, the valve configured to control fluid flow through the fluid conduit;

a prime mover configured to rotate a drive shaft;

a pump having a plunger disposed at least partially within the block of the fluid end, the pump being coupled to the drive shaft of the prime mover via a transmission, the transmission configured to transfer rotational energy from the drive shaft to the pump;

one or more sensors configured to generate sensor data associated with at least one of the prime mover, the pump, or the transmission, the sensor data including at least one of:

driver speed data indicative of a driver speed of the prime mover, or transmission data indicative of a transmission state; and a controller communicatively coupled to the one or more sensors, the controller configured to:

position the valve in an open position or a closed position, wherein fluid is directed through the fluid conduit when the valve is in the open position and fluid is directed only to the fluid manifold via the fluid outlet when the valve is in the closed position, receive the sensor data from the one or more sensors, determine, based at least in part on the sensor data, whether the driver speed is:

less than a threshold driver speed, or equal to or greater than the threshold driver speed, determine, based at least in part on the sensor data, whether the transmission is engaged or disengaged, and cause the valve to be positioned in the open position, based at least in part on determining that the driver speed is less than the threshold driver speed and determining that the transmission is engaged.

8. The fluid system of claim 7, wherein the controller is further configured to:

cause the valve to be positioned in the closed position, based at least in part on determining that the driver speed is equal to or greater than the threshold driver speed and determining that the transmission is engaged.

9. The fluid system of claim 7, wherein the controller is further configured to:

maintain a current valve position, based at least in part on determining that the transmission is disengaged.

10. The fluid system of claim 7, wherein the valve is a first valve and the fluid system further includes:

a second valve fluidly coupled to the fluid conduit, the second valve configured to control fluid flow through the fluid conduit; and respective actuators coupled to each of the first valve and the second valve, wherein the respective actuators are configured to position the first valve in the open position or the closed position and to position the second valve in a partially open position or a partially closed position to choke fluid flow through the fluid conduit.

11. The fluid system of claim 10, wherein the controller is further configured to cause the respective actuators to position the first valve and the second valve.

12. The system of claim 2, wherein the controller is further configured to:

determine, based at least in part on the sensor data, whether a value of a parameter of the system is less than a threshold value; and based on determining that the value of the parameter is less than the threshold value, maintain a closing rate of the valve.

13. The system of claim 12, wherein the controller is further configured to, based on determining that the value of the parameter is greater than the threshold value, reduce the closing rate of the valve.

14. The system of claim 12, wherein determining whether the value of the parameter of the system is less than the threshold value includes determining at least one of:

whether a load of the prime mover is below a predetermined prime mover load threshold, whether a load of the pump is below a predetermined pump threshold, whether a volumetric flow rate of fluid flowing through the valve is below a predetermined flow rate threshold, or whether a fluid velocity of fluid across the valve is below a predetermined fluid velocity threshold.

15. The fluid system of claim 8, wherein the controller is further configured to:

determine, based at least in part on the sensor data, whether a value of a parameter of the system is less than a threshold value;

based on determining that the value of the parameter of the system is less than the threshold value, maintain a closing rate of the valve; and based on determining that the value of the parameter of the system is greater than or equal to the threshold value, reduce the closing rate of the valve.

16. A method comprising:

receiving sensor data from one or more sensors, the sensor data generated by one or more sensors associated with at least one of a prime mover, a pump, or a transmission, the prime mover configured to drive operation of the pump via the transmission, the sensor data including at least one of:

driver speed data indicative of a driver speed of the prime mover, or transmission data indicative of a transmission state of the transmission;

determining, based at least in part on the sensor data, that the driver speed is less than a threshold driver speed;

determining, based at least in part on the sensor data, that the transmission is engaged; and causing an actuator coupled to a valve to transition the valve to the open position, based at least in part on determining that the driver speed is less than the threshold driver speed and that the transmission is engaged.

17. The method of claim 16, further comprising:

determining, based at least in part on the sensor data, that the transmission is disengaged; and maintaining a current valve position, based at least in part on determining that the transmission is disengaged.

18. The method of claim 16, further comprising:

determining, based at least in part on the sensor data, that the driver speed is equal to or greater than a threshold driver speed;

determining, based at least in part on the sensor data, that the transmission is engaged; and causing the actuator to transition the valve to the closed position, based at least in part on determining that the driver speed is equal to or greater than the threshold driver speed and determining that the transmission is engaged.

19. The method of claim 18, wherein:

causing the actuator to transition the valve to the open position includes sending one or more first signals to the actuator, and causing the actuator to transition the valve to the closed position includes sending one or more second signals to the actuator.

20. The method of claim 18, wherein the actuator transitions the valve to the open position or the closed position during a predetermined amount of time in order to reduce a rate of load on the prime mover driving operation of the pump.

* * * * *